United States Patent [19]

Kleiner

Best Available Copy

[11] 4,412,563

[45] Nov. 1, 1983

[54] MULTIPOSITION DOBBY

[75] Inventor: Walter Kleiner, Hirzel-Zurich, Switzerland

[73] Assignee: Staeubli Ltd., Horgen-Zuerich, Switzerland

[21] Appl. No.: 276,544

[22] Filed: Jun. 22, 1981

[30] Foreign Application Priority Data

Jul. 1, 1980 [CH] Switzerland ..... 5047/80

[51] Int. Cl.[3] ..... D03C 1/00; D03C 1/06

[52] U.S. Cl. ..... 139/66 R; 139/71

[58] Field of Search ..... 139/66 R, 66 A, 55.1, 139/57, 71, 74, 82

[56] References Cited

FOREIGN PATENT DOCUMENTS

| | | | |
|---|---|---|---|
| 1106704 | 5/1961 | Fed. Rep. of Germany | 139/71 |
| 1949529 | 4/1971 | Fed. Rep. of Germany | 139/71 |
| 1710183 | 7/1972 | Fed. Rep. of Germany | 139/71 |
| 2719987 | 9/1978 | Fed. Rep. of Germany | 139/71 |
| 3038173 | 4/1981 | Fed. Rep. of Germany | 139/82 |
| 1201358 | 7/1959 | France | 139/66 R |

*Primary Examiner*—James Kee Chi

*Attorney, Agent, or Firm*—Flynn, Thiel, Boutell & Tanis

[57] ABSTRACT

To move pile heddle frames between three or rather four shed positions, a four-position rocking lever is arranged between two adjacent heddle frame lifting units and the rocking lever controlling the heddle frame. The free end of the first lifting unit rocking lever is a hinge point for the four-position rocking lever and the free end of the second lifting unit rocking lever is a hinge point for a connecting bar extending to the four-position rocking lever. To reduce wild movements of the heddle frame, no loaded shafts are provided in the power-transmitting path from the lifting unit to the heddle frame, aside from shafts supporting the lifting units and the rocker arm of the heddle frame.

13 Claims, 12 Drawing Figures

MULTIPOSITION DOBBY

FIELD OF THE INVENTION

This invention relates to a multiposition dobby, preferably for pile heddle frames, comprising two lifting units of a shed-forming machine for controlling a loom heddle frame, wherein a rocking lever is provided in the drive train between the lifting units and heddle frame, which rocking lever can be moved by the two heddle frame lifting units between four different positions, two of which intersect at a point.

BACKGROUND OF THE INVENTION

Through Swiss Pat. No. 527,935 (corresponding to U.S. Pat. No.3,759,298), such a dobby for controlling weaving machines has become known. By additively coupling the control effects of the two heddle frame lifting units in the transmitting drive train, a rocking lever can be moved into four operating positions. If the heddle frame connecting rod is hinged to the rocking lever at the point of intersection of two positions of the rocking lever, two of the operating positions of the heddle frame will be identical. In other words, only three different heddle frame positions are then obtained.

Such power-transmitting drives are subjected to usually heavy stresses because the particularly heavy heddle frame of a weaving machine for plush fabrics must be moved at high speed over almost twice the shed-lifting path as the heddle frame of a weaving machine for smooth fabrics.

The pile threads which are controlled with such heddle frames are usually filaments which are not twisted or are only weakly twisted and thus have a tendency to break under the influence of unusual heddle frame vibrations. Such vibrations do occur, particularly due to elastic deformations of the alternately loaded bearing shafts for the reciprocating levers and through the series of bearing points and hinge points of connecting bars and rods in the path of movement of the power-transmitting drive.

These uncontrolled, wild vibrations, which in simple machines are insignificant, add up in the drive between lifting units and heddle frame of machines for plush fabrics, which leads to additional vibrations of the heddle frames and thus to breaking of the pile threads.

A purpose of the invention is thus, as much as possible, to provide a dobby which reduces the wild, vibration like movements of the heddle frame.

SUMMARY OF THE INVENTION

This is attained with a multiposition dobby of the type described above in which only the levers in direct, operative connection with the lifting units and which directly effect movement of the heddle frame are supported on stationary axes, the four-position rocking lever being supported through two joints, one joint connecting the rocking lever to a movement lever or a bar of a lifting unit so that the rocking lever swings along with said lever or bar, and the other joint connecting the rocker lever for limited movement to guide levers which in turn are operatively connected to the movement levers of the second lifting unit so that the drive train between the heddle frame lifting units and actuating mechanism of the heddle frame is free of stationary shafts which are loaded by heddle frame driving forces.

The control movements are thus transmitted directly from the lifting units onto the rocking lever and from the rocking lever to the heddle frame actuating mechanism. The number of power-loaded shafts is thus reduced to a minimum.

As heddle frame lifting units, it is possible to use all conventional systems, including the Hattersley system, rotation machines, stepping devices and the like, wherein the lifting units themselves must be constructed as parts which carry the lever drive.

BRIEF DESCRIPTION OF THE DRAWINGS

Several exemplary embodiments of the invention are illustrated in the drawings, in which.

DETAILED DESCRIPTION

The basic mode of operation and action of the illustrated multiposition dobbies having four-position rocking levers corresponds with the dobby which is described in Swiss Pat. No. 527,935 (corresponds to U.S. Pat. No. 3,759,298, the disclosure of which is incorporated herein by reference).

Figure 1:
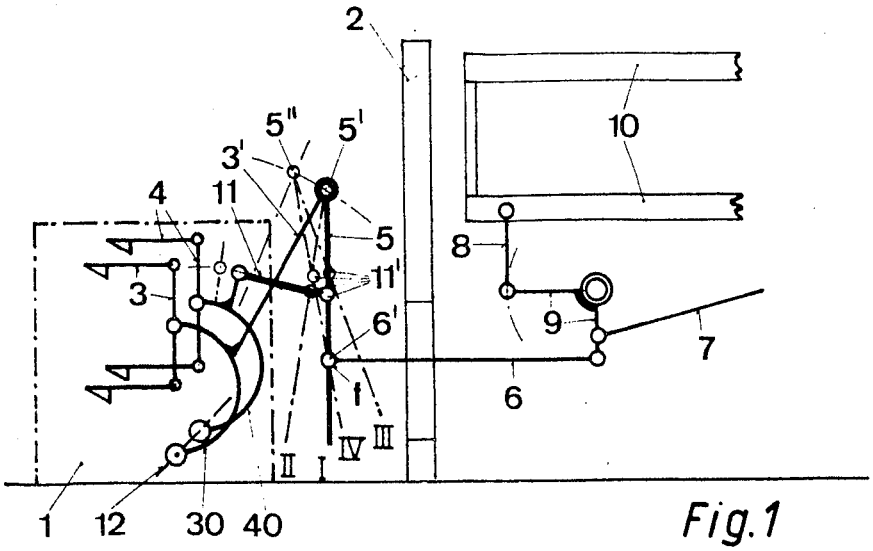
FIG. 1 schematically illustrates a dobby with two lifting units of the Hattersley system and a rodlike four-position rocking lever which serves as a control part for a heddle frame.

FIG. 1 identifies a dobby with reference numeral 1 and the associated weaving machine with reference numeral 2. Two draw hooks on each of two lifting units 3 and 4 of the Hattersley system are illustrated schematically and are hinged to the opposite ends of the associated baulks. Two rocking levers 30 and 40 are pivotally supported on a fixed shaft 12 and each pivotally engages at a central location a respective one of the baulks, wherein on the arm 3' of the rocking lever 30, through the free pivotal joint 5', a rodlike four-position rocking lever 5 is hinged. The arm 4' of the other rocking lever 40 is pivotally connected to a bar 11 which in turn is pivotally connected to the rocking lever 5. The latter hinge point is identified with reference numeral 11'. A rod 6 leads from a slide part 6', which is movable along and releasably securable to the rocking lever 5, to a two-arm rocker arm 9 which is pivotally supported on a fixed shaft. One arm of the rocker arm 9 is pivotally connected to a push rod 7 and the other arm is pivotally connected to a push rod 8 for a heddle frame 10. In place of the bar 11 it is also possible to arrange a link connection between the rocking lever 40 and the rocking lever 5.

The base position I of the four-position rocking lever 5 is illustrated in FIG. 1 in solid lines. If a draw hook of the lifting unit 4 is pulled out, the joint 5' does not change its position. Rather, the bar 11 is moved and the rocking lever 5 swings from position I into position II. If, alternatively, a draw hook of the lifting unit 3 is pulled out, then the joint 5' is swung with the arm 3' to location 5'' and the four-position rocking lever 5 assumes the position III. If draw hooks of each lifting unit are pulled out simultaneously, then the position IV of the rocking lever 5 is obtained. In this position, the rocking lever 5 intersects its position I at point f. Thus, if the rod 6 is connected to the lever 5 at point f, it remains substantially motionless during movement of the four-position rocking lever from position I to position IV. When the rod 6 is connected to the lever 5 at any other point, the path of movement of the slide part 6' which is releasably secured to the rocking lever 5 results, upon movement of the rocking lever 5 from position I to position IV, in a degree of the movement of the rod 6 and thus the heddle frame 10.

The point of intersection f of the rocking lever in the positions I and IV lies outside of the hinge points 5' and 11'.

In FIGS. 2–7 one again recognizes the two lifting units 3 and 4 of the Hattersley system, wherein at the end of the arm 3' (FIG. 2) of rocking lever 30 there is arranged the pivot joint 5' for the four-position rocking lever 50. The rocking lever 50 is a two-arm angle lever, to one arm of which is pivotally connected the connecting bar 11 which in turn is pivotally connected to the rocking lever 40 and on the other arm of which is provided the movable and releasably securable slide part 6'. The movement which is produced by the lifting units and determined measurably by the four-position rocking lever 50 is transferred onto the heddle frame 10 of the weaving machine 2 through the rod 6, the rocking lever 9 and the push rods 7 and 8.

Figure 2:
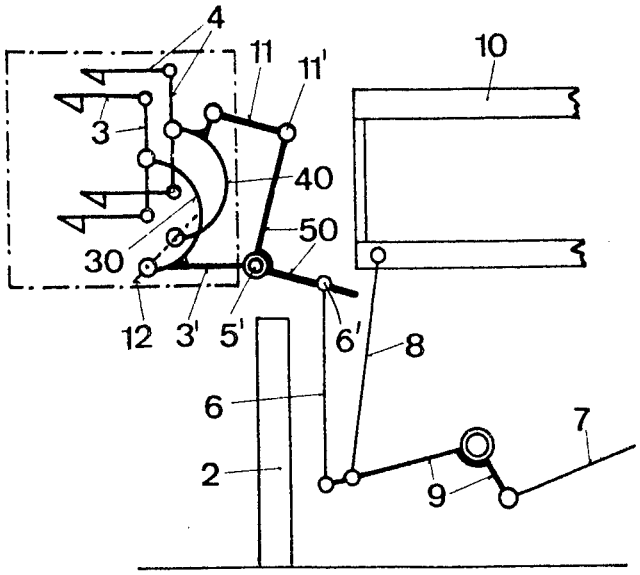
FIG. 2 schematically illustrates a modification of the device of FIG. 1, wherein the four-position rocking lever is an angle lever.
Figure 3:
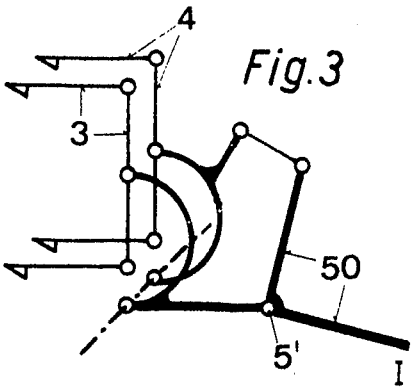
FIGS. 3 to 6 schematically illustrate the device of FIG. 2 in the four respective control positions.
Figure 4:
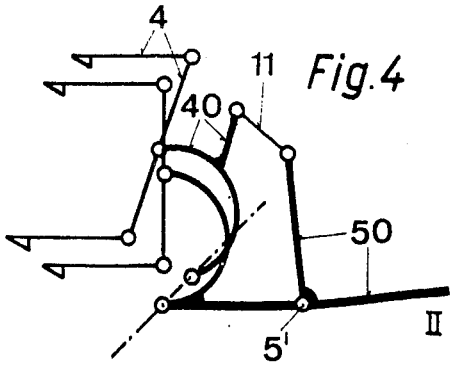
Figure 5:
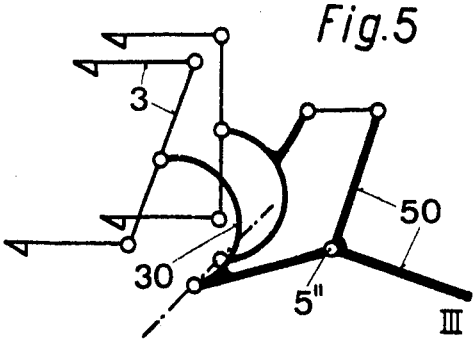
Figure 6:
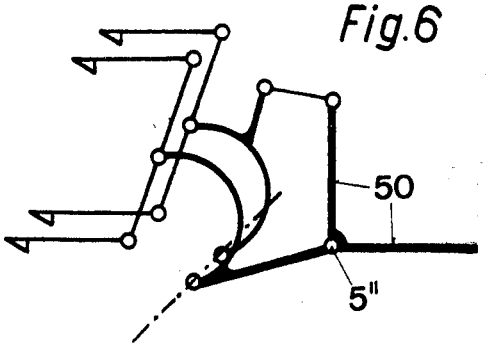
Figure 7:
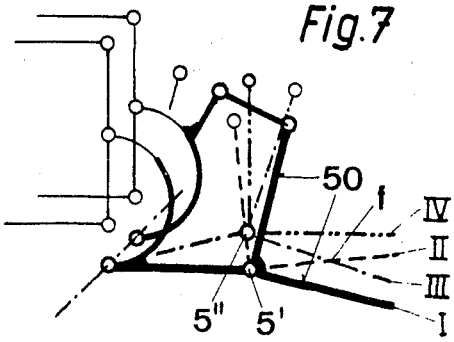
FIG. 7 schematically illustrates the device of FIG. 2, wherein all four control positions are illustrated.

FIG. 3 illustrates the base position I of the rocking lever 50, which base position corresponds to FIG. 2. By pulling out the draw hook of the rear lifting unit 4, the rocking lever 50 is pivoted about the stationary joint 5' by the rocking lever 40 and the bar 11 into the position II (FIGS. 4 and 7). If a draw hook of the front lifting unit 3 is pulled out, then the joint 5' is swung by the rocking lever 30 to 5'', and the rocking lever 50 is swung into the position III (FIGS. 5 and 7). Upon simultaneously pulling out a draw hook of both lifting units 3 and 4, the rocking lever 50 moves to the position IV (FIGS. 6 and 7).

As can be seen from FIG. 7, the positions II and III of the rocking lever intersect at the point f. The heddle frame is, in the shed intersection, between the two loom sheds.

Figure 8:
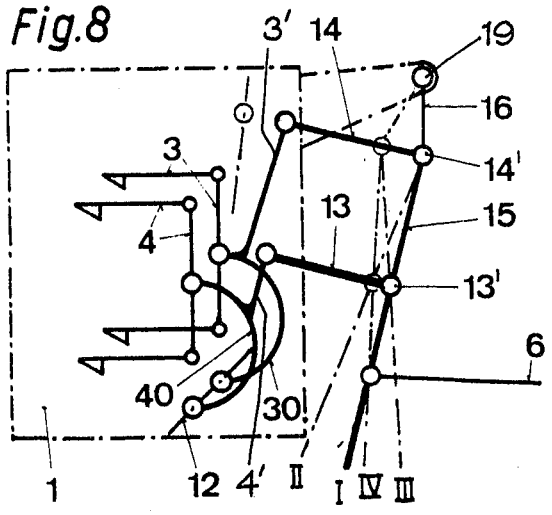
FIg. 8 schematically illustrates another modified embodiment of FIG. 1 in which the rodlike four-position rocking lever is suspended from the dobby housing on a bar.

In the embodiment according to FIG. 8, the rodlike four-position rocking lever 15 is removed from the actual dobby. The rocking lever 15 is not directly connected to any rocking lever which is supported on the fixed shaft 12, but is freely hinged on the bars 13 and 14. An additional bar 16 is therefore needed, which freely, swingably suspends the joint 14' from a point 19 on the machine frame for limited movement. The bar 16 can also be replaced with a link guide, as is illustrated, for example, in FIG. 10. The bars 13 and 14 are each pivotally supported at the end on an arm 4' or 3' or a respective one of the rocking levers 40 and 30, and are each pivotally connected at the opposite end to the four-position rocking lever 15.

The four positions of the four-position rocking lever 15 in FIG. 8 are identified with reference numerals I, II, III and IV.

Each lifting unit 3 and 4 can be replaced by one of different construction. For certain cases, particularly high speed machines, the lifting units which have become known under the name "rotation dobbies" have proven to be successful, such as those in Swiss Pat. No. 396,791 (corresponds to U.S. Pat. No. 3,180,366, the disclosure of which is incorporated herein by reference). It is, for example, possible to obtain higher weft numbers per unit of time with such units.

Figure 9:
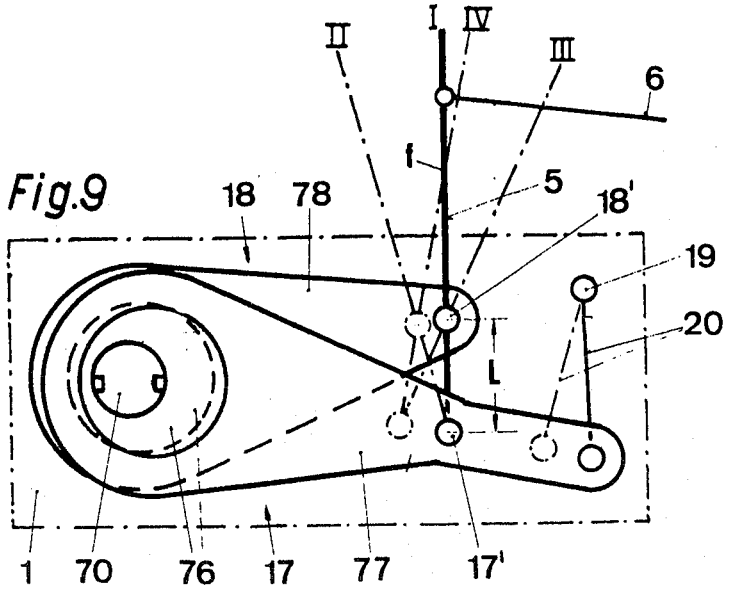
FIG. 9 schematically illustrates an alternative embodiment having two lifting units of a rotation dobby with a rodlike four-position rocking lever.

FIG. 9 schematically illustrates two such rotation lifting units 17 and 18 adjacent each other and without the associated control mechanisms. Each lifting unit 17 and 18 includes an eccentric ring 76 rotatably supported on the shaft 70 and a respective connecting rod 77 or 78 slidably supported on the eccentric ring 76. Depending on a patternlike control effected by a not-illustrated mechanism similar to that in U.S. Pat. No. 3,180,366, the eccentric rings 76 are independently and periodically rotated at least 180° by shaft 70. From this results a radial back and forth movement of the connecting rods 77 and 78 which is to be considered as a lifting movement. The rodlike four-position rocking lever 5 is pivotally hinged on the two connecting rods 77 and 78 at 17' and 18', respectively, which permits movement to the four positions I, II, III and IV, depending on whether one, the other or both lifting units carry out a lifting movement. The connecting rods 77 and 78 which project radially from the drive shaft form an acute angle with respect to each other. The positions I and IV of the rocking lever intersect here also at a point f. Decisive in determining the angle of the rocking lever in the various positions is the distance L between the points at which the rocking lever is connected to the two connecting rods. To stabilize the connecting rods 77 and 78, the connecting rod 77 is suspended freely swingably by a bar 20, one end of the bar 20 being pivotally connected to the rod 77 and the other end pivotally connected to a fixed part 19 of the dobby housing. Through this, the limited movability of the two lifting units and of the four-position rocking lever is provided.

Figure 10:
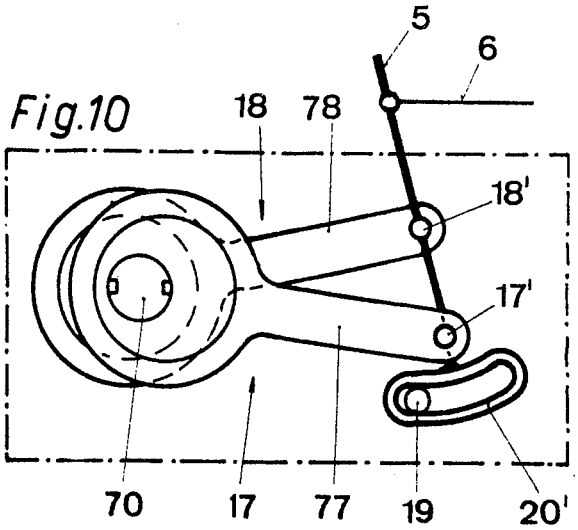
FIG. 10 schematically illustrates a modification of the embodiment according to FIG. 9.

FIG. 10 illustrates an embodiment having two rotation lifting units 17 and 18 arranged on the drive shaft 70, similar to the arrangement according to FIG. 9. The bar 20 is replaced with a link 20' which has an elongate, arcuate slot therein, is secured on the lower end of the lever 5 and slides over the fixed bolt 19, through which the approximate angle position of the connecting rod is determined. The second connecting rod is identified with reference numeral 78 and the rodlike four-position rocking lever is identified with reference numeral 5. The rocking lever 5 is pivotally connected at 17' and 18' to the connecting rods 77 and 78. The rod 6 is connected to the actuating mechanism for the heddle frame.

Figure 11:
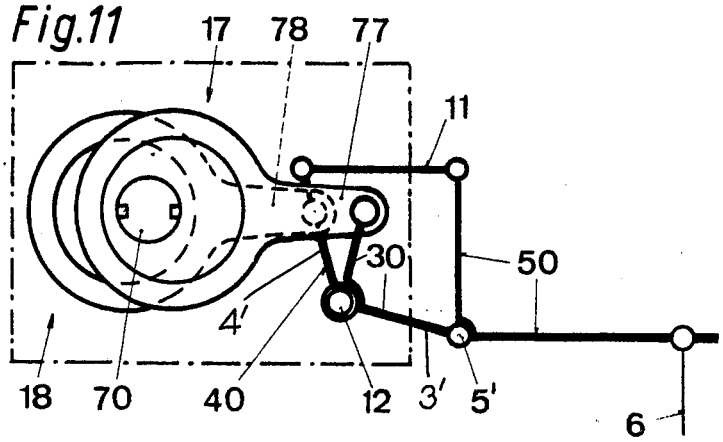
FIG. 11 schematically illustrates a modification of the embodiment of FIG. 9 wherein the four-position rocking lever is constructed as an angle lever.

As is illustrated in FIG. 11, it is alternatively possible to hinge to each connecting rod 77 or 78 a respective rocking lever 30 or 40 which is pivotally supported on a fixed shaft 12. A two-arm four-position rocking lever 50 is hinged on the one hand at its vertex 5' to an arm 3' of the lever 30 and on the other hand at the end of one arm to the bar 11 which in turn is hinged to the arm 4' of the rocking lever 40 so that the rocking lever 50 hanges practically freely in space. The rod 6 for the heddle frame engages the other arm of the rocking lever 50.

Figure 12:
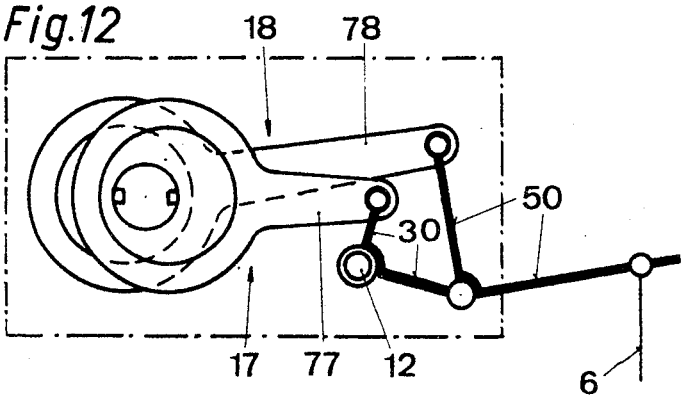
FIG. 12 schematically illustrates a modificationof the embodiment according to FIG. 11.

In the embodiment according to FIG. 12, only one rotation lifting unit 17 has a rocking lever 30, which lever is pivotally supported on the fixed shaft 12, has one arm hinged to the connecting rod 77 and has the other arm pivotally supporting a two-arm rocking lever 50. The lever 50 has one arm hinged to the connecting rod 77 of the second rotation lifting unit 18, and the rod 6 for the heddle frame engages the other arm of the lever 50.

The various exemplary embodiments illustrate that power transfer using a four-position rocking lever in the drive between the lifting unit and the heddle frame is independent of the type of lifting unit.

The illustrated examples illustrate adjacent lifting units with almost equal strokes, which lifting units could, however, have different strokes in one and the same multiposition dobby.

All the modified embodiments, aside from indispensible shafts which support the lifting units and the rocking arms of the heddle frame, are free of shafts which are loaded by the heddle frame driving forces. A direct connection of the lifting units with the four-position rocking lever exists. The support bars or link guides are only nominally loaded by heddle frame driving forces, which results in quiet, vibration- free and exact heddle frame movement.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A dobby for controlling a multiposition heddle frame, comprising first and second rotation lifting units arranged adjacent each other on a common rotationally driven drive shaft and respectively having first and second connecting rods which extend and are supported for movement in directions generally radial of said drive shaft and form an acute angle with respect to each other, a lever pivotally supported on said first connecting rod at a first location spaced from said drive shaft and pivotally supported on said second connecting rod at a second location spaced from said drive shaft and from said first location, a third connecting rod pivotally supported on said lever at a third location spaced from said first and second locations, means operatively coupling said third connecting rod to said heddle frame for effecting movement of said heddle frame in response to movement of said third connecting rod effected by pivotal movement of said lever, and means for preventing angular movement of said first and second connecting rods with respect to the axis of said drive shaft.

2. The dobby of claim 1, wherein said first location on said lever is between said second and third locations thereon.

3. The dobby of claim 2, including means for effecting said pivotal support of said third connecting rod on said lever at a selected one of a plurality of locations along said lever, said third location being said selected location.

4. The dobby of claim 1, wherein said means for preventing angular movement of said first and second connecting rods includes an elongate bar supported at one end for pivotal movement about a stationary axis and having the other end supported for pivotal movement on said first connecting rod at a location spaced from said drive shaft and from said first location.

5. The dobby of claim 1, wherein said means for preventing angular movement of said first and second connecting rods includes a link which is supported on said lever at a fourth location spaced from said first, second and third locations and has an elongate slot therein, and including a stationary bolt on said dobby which is slidably received in said slot in said link.

6. A dobby for controlling a multiposition heddle frame, comprising first and second lifting units which have respective movably supported first and second drive members, first and second levers respectively supported for pivotal movement about first and second stationary axes, said first and second levers being respectively pivotally coupled to said first and second drive members at respective locations spaced from said first and second axes, movement of said first and second drive members respectively effecting pivotal movement of said first and second levers, a third lever pivotally supported on said first lever at a first location spaced from said first axis, an elongate bar having one end pivotally supported on said second lever at a location spaced from said second axis and the other end pivotally supported on said third lever at a second location spaced from said first location, a connecting rod pivotally supported on said third lever at a third location spaced from said first location, and means operatively coupling said third connecting rod and said heddle frame for effecting movement of said heddle frame in response to movement of said third connecting rod effected by pivotal movement of said third lever.

7. The dobby of claim 6, wherein said third lever is substantially rectilinear and said second location is between said first location and said third location.

8. The dobby of claim 6, wherein said third lever has two arms arranged at an angle to one another, said first location being in the region of said intersection of said arms, said second location being on one of said arms, and said third location being on the other of said arms.

9. The dobby of claim 6, including means for effecting said pivotal support of said connecting rod on said third lever at a selected one of a plurality of locations along said third lever, said third location being said selected location.

10. The dobby of claim 6, wherein said first and second lifting units are rotation lifting units which are arranged adjacent each other on a common rotationally driven drive shaft and respectively have first and second connecting rods which extend and are supported for movement in directions generally radial of said drive shaft and respectively serve as said first and second driving members.

11. The dobby of claim 6, wherein said lifting units are Hattersley lifting units which each have two draw hooks pivotally supported at opposite ends of a baulk, each said baulk being a respective one of said driving members and being pivotally connected to a respective one of said first and second levers at a location between said pivotal connections to said draw hooks.

12. A dobby for controlling a multiposition heddle frame, comprising first and second rotation lifting units arranged adjacent each other on a common rotationally driven drive shaft and respectively having first and second connecting rods which extend and are supported for movement in directions generally radial of said drive shaft, a first lever supported for pivotal movement about a stationary axis and pivotally coupled to said first connecting rod at a first location spaced from said stationary axis, radial movement of said first connecting rod effecting pivotal movement of said first lever, a second lever pivotally supported on said first lever at a second location spaced from said stationary axis and pivotally coupled to said second connecting rod at a third location spaced from said second location, radial movement of said second connecting rod effecting pivotal movement of said second lever with respect to said first lever, a third connecting rod pivotally supported on said second lever at a fourth location spaced from said second location, and means operatively coupling said third connecting rod to said heddle frame for effecting movement of said heddle frame in response to movement of said third connecting rod effected by pivotal movement of said second lever.

13. The dobby of claim 12, wherein said first lever has first and second arms which are arranged at an angle to one another and intersect in the region of said stationary axis, said first and second locations respectively being provided on said first and second arms, and wherein said second lever has third and fourth arms which are arranged at an angle to one another and intersect in the region of said second location, said third and fourth locations respectively being provided on said third and fourth arms.

* * * * *